US007954551B2

(12) United States Patent
Bolding

(10) Patent No.: US 7,954,551 B2
(45) Date of Patent: Jun. 7, 2011

(54) SYSTEM AND METHOD FOR THRU TUBING DEEPENING OF GAS LIFT

(75) Inventor: Jeffrey L. Bolding, Kilgore, TX (US)

(73) Assignee: BJ Services Company LLC, Houston, TX (US)

( * ) Notice: Subject to any disclaimer, the term of this patent is extended or adjusted under 35 U.S.C. 154(b) by 111 days.

(21) Appl. No.: 12/420,425

(22) Filed: Apr. 8, 2009

(65) Prior Publication Data

US 2009/0255684 A1 Oct. 15, 2009

(51) Int. Cl.
*E21B 43/00* (2006.01)

(52) U.S. Cl. ..... 166/372; 166/106

(58) Field of Classification Search ..... 166/372, 166/106, 105.6
See application file for complete search history.

(56) References Cited

U.S. PATENT DOCUMENTS

| | | | | |
|---|---|---|---|---|
| 12,143 | A | 1/1855 | Tucker | |
| 2,416,842 | A | 3/1947 | O'Leary | |
| 4,022,273 | A | 5/1977 | Marathe | |
| 4,387,767 | A | 6/1983 | Read | |
| 4,490,095 | A | 12/1984 | Soderberg | |
| 4,545,731 | A * | 10/1985 | Canalizo et al. | 417/86 |
| 4,589,482 | A * | 5/1986 | Bayh, III | 166/105.5 |
| 4,616,981 | A | 10/1986 | Simmons et al. | |
| 4,632,184 | A * | 12/1986 | Renfroe et al. | 166/105.5 |
| 4,646,827 | A | 3/1987 | Cobb | |
| 5,092,400 | A | 3/1992 | Jagert | |
| 5,148,865 | A | 9/1992 | Reed | |
| 5,203,409 | A | 4/1993 | Seid et al. | |
| 5,522,464 | A | 6/1996 | Piper | |
| 5,662,169 | A | 9/1997 | Hosie | |
| 5,727,631 | A | 3/1998 | Baker et al. | |
| 5,915,475 | A | 6/1999 | Wells et al. | |
| 6,467,541 | B1 | 10/2002 | Wells | |

(Continued)

FOREIGN PATENT DOCUMENTS

CA 2310236 12/2001

(Continued)

OTHER PUBLICATIONS

Search Report & Written Opinion dated Oct. 12, 2006 from PCT/US2005/35601.

(Continued)

*Primary Examiner* — Giovanna C Wright
(74) *Attorney, Agent, or Firm* — Zarian Midgley & Johnson PLLC

(57) ABSTRACT

The present disclosure is directed to a gas lift system adapted to provide a gas injection point to a deeper location in a wellbore. A turn-over suspension mandrel can be landed inside a side pocket mandrel and connected to a gas lift valve on one end and a coil on the other end. A length of production tubing can extend from the side pocket mandrel. The production tubing can include a production packer to seal the annulus between the tubing and the well casing. The turn-over suspension mandrel can be constructed such that gas entering the gas lift valve is directed down through the coil and into the wellbore beneath the production packer. A plug can be placed at the bottom of the coil in order to prevent blowouts during installation of the gas lift system. An alternative embodiment of the present disclosure provides a coil and plug hung from a gas lift valve of a pack-off assembly.

15 Claims, 3 Drawing Sheets

U.S. PATENT DOCUMENTS

| | | | | |
|---|---|---|---|---|
| 6,688,386 | B2 | 2/2004 | Cornelssen et al. | |
| 6,715,554 | B1 | 4/2004 | Cunningham et al. | |
| 6,851,478 | B2 | 2/2005 | Cornelssen et al. | |
| 7,025,132 | B2 | 4/2006 | Kent et al. | |
| 7,325,600 | B2 | 2/2008 | Sieben | |
| 7,699,099 | B2 | 4/2010 | Bolding et al. | |
| 7,770,637 | B2 * | 8/2010 | Phoi-montri et al. | 166/129 |
| 2002/0000315 | A1 | 1/2002 | Kent et al. | |
| 2002/0134548 | A1 | 9/2002 | Lam et al. | |
| 2003/0056958 | A1 * | 3/2003 | Allan | 166/372 |
| 2004/0112604 | A1 | 6/2004 | Milberger et al. | |
| 2004/0154790 | A1 | 8/2004 | Cornelssen et al. | |
| 2004/0262010 | A1 | 12/2004 | Milberger | |
| 2005/0022998 | A1 | 2/2005 | Rogers, Jr. | |
| 2005/0175476 | A1 | 8/2005 | Patterson | |
| 2005/0249613 | A1 | 11/2005 | Jordan et al. | |
| 2006/0008364 | A1 | 1/2006 | Traylor | |
| 2008/0029271 | A1 | 2/2008 | Bolding et al. | |

FOREIGN PATENT DOCUMENTS

| | | |
|---|---|---|
| CA | 2497090 | 8/2006 |
| EP | 0637675 | 2/1995 |
| GB | 2377954 | 1/2003 |
| WO | WO9904137 | 1/1999 |

OTHER PUBLICATIONS

Examiner's Second Examination Report dated Mar. 22, 2010 from related AU Patent Application No. AU2006279282.
Examiner's First Report dated Nov. 2, 2009 from related AU Patent Application No. AU2006279282.
First Exam Report dated Nov. 23, 2009 from related CA Patent Application No. 2619570.
Search Report and Written Opinion dated Sep. 27, 2007 from PCT Application No. PCT/US2006/32504.
Office Action dated Feb. 1, 2010 from related U.S. Appl. No. 11/463,937.
Final Office Action dated Sep. 16, 2009 from related U.S. Appl. No. 11/463,937.
International Preliminary Report on Patentability dated Feb. 12, 2009 from related PCT Application No. PCT/US2007/017226.
International Search Report & Written Opinion dated Jan. 18, 2008 from related PCT Application No. PCT/US2007/017226.
Office Action dated Mar. 13, 2009 from related U.S. Appl. No. 11/461,858.
Office Action dated Aug. 4, 2008 from related U.S. Appl. No. 11/461,858.
Office Action dated Apr. 17, 2007 from U.S. Appl. No. 11/057,214.
Office Action dated Jun. 19, 2009 from related U.S. Appl. No. 11/461,858.
Office Action dated Dec. 31, 2008 from related U.S. Appl. No. 11/461,858.
"Conventional DHSV Coiled Tubing Completion" obtained from http://www.pedcor.com/wellhead-equipment/conventional_dhsv_ct_completion.html, 3-pgs.
"RF Hanger from PEDCOR" obtained from http://www.pedcor.com/wellhead-quipment/rf_hanger.html, 3-pgs.
PEDCOR "Series 10-400 Chemical Injector Adaptor" dated Jan. 5, 1995.
PEDCOR "Wellhead Equipment Sub: Standard Hanger Mandrel Type" obtained from http://www.pedcor.com/wellhead-equipmnet/standard_mandrel_hanger.html, 3-pgs.
Select Energy Systems, "Installation Procedure: Model 2500 CT Hanger", undated, obtained from http://www.selectesi.com/select_energy/PDFs/02.pdf, 2-pgs.
Select Energy Systems, "Model 2500 Flanged CT Hanger", Publisher: undated, obtained from http://www.selectesi.com/select_energy/PDFs/04.pdf, 1-pg.
Select Energy Systems, "Model 2500R Flanged CT Hanger", Publisher: undated, obtained from http://www.selectesi.com/select_energy/PDFs/01.pdf, 1-pg.
Office Action dated Sep. 15, 2009 from related U.S. Appl. No. 12/208,646.
Office Action dated Mar. 9, 2010 from related U.S. Appl. No. 12/208,646.
International Search Report and Written Opinion dated Apr. 23, 2008 from related PCT Application No. PCT/US2008/050752.
Office Action dated Sep. 15, 2009 from related U.S. Appl. No. 11/972,399.
Office Action dated Mar. 24, 2010 from related U.S. Appl. No. 11/972,399.
Canadian Office Action dated Aug. 13, 2008 from related Canadian Application No. CA 2,497,090.
Office Action dated Oct. 20, 2006 from related U.S. Appl. No. 11/057,214.
U.S. Appl. No. 11/463,937, filed Aug. 11, 2006 in the name of Jeffrey L. Bolding.
U.S. Appl. No. 11/972,399, filed Jan. 10, 2008, in the name of Jeffrey L. Bolding, et al.
U.S. Appl. No. 12/208,646, filed Sep. 11, 2008, in the name of Jeffrey L. Bolding, et al.
U.S. Appl. No. 11/664,646, filed Feb. 27, 2008, in the name of Jeffrey L. Bolding, et al.

* cited by examiner

SYSTEM AND METHOD FOR THRU TUBING DEEPENING OF GAS LIFT

BACKGROUND

1. Field of the Disclosure

The present disclosure relates, in general, to gas lift systems and, in particular, to a gas lift system adapted to introduce gas to a deeper location in the wellbore.

2. Description of the Related Art

Gas lift systems are typically designed and installed as part of a downhole completion in an oil well. The purpose of a gas lift system is to introduce gas below the fluid column in order to increase the velocity of the fluid, thereby lifting the fluid to the surface. Gas lift systems typically have several locations or injection points, from top to bottom, for the release of gas within the wellbore. Due to the nature of packers and sand screens used in wells today, the gas injection points are located above the packer and/or screen. The most important of these injection points is generally the lowest injection point in the well.

There are drawbacks to the current gas lift systems. On occasion, depletion of the well causes the gas lift to become less effective. In order to improve the efficiency of the gas lift system, the lowest injection point must be placed at a deeper location. To accomplish this, a workover is required. However, even after the workover is completed, the deepest depth of the lowest gas injection point will be only slightly above the production packer, limiting the effectiveness of the gas lift. In light of the foregoing, there is a need in the art for a gas lift system which introduces a gas injection point to a deeper location, thereby addressing the above deficiencies of the prior art.

The present disclosure is directed to overcoming, or at least reducing the effects of, one or more of the issues set forth above.

SUMMARY

The present disclosure is directed to a gas lift system adapted to provide a gas injection point to a deeper location in a wellbore. A turn-over suspension mandrel can be landed inside a side pocket mandrel and connected to a gas lift valve on one end and a coil on the other end. A length of production tubing can extend from the side pocket mandrel. The production tubing can include a production packer to seal the annulus between the tubing and the well casing. The turn-over suspension mandrel can be constructed such that gas entering the gas lift valve is directed down through the coil and into the wellbore to a deeper location beneath the production packer. A plug can be placed at the bottom of the coil in order to prevent blowouts during installation of the gas lift system. An alternative embodiment of the present disclosure provides a coil and plug hung from a gas lift valve of a pack-off assembly.

Figure 1:
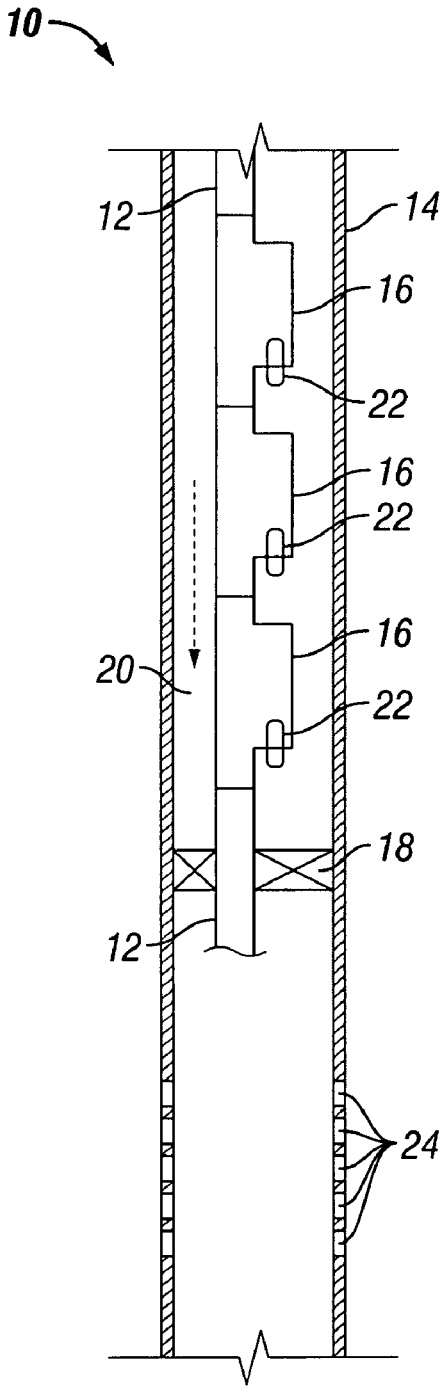
FIG. 1 (Prior Art)
FIG. 1 illustrates a gas lift system according to the prior art.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

Illustrative embodiments of the disclosure are described below as they might be employed in the construction and use of a gas lift system and method according to the present disclosure. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments and methods of the present disclosure will become apparent from consideration of the following description and drawings.

FIG. 1 illustrates a gas lift system 10 according to the prior art. A production tubing 12 is run inside casing 14 as understood in the art. A series of side pocket mandrels 16 are connected, one atop the other, beneath the tubing 12. Side pocket mandrels are known in the art. A gas lift valve 22 is located within the lower end of the side pocket of each side pocket mandrel 16. Gas lift valves 22 operate to equalize the fluid pressure within tubing 12 and annulus 20. As such, gas lift valves 22 regulate the amount of gas injected from the annulus into the tubing 12, which is used to lift the production fluids to the surface. The operation of gas lift valves is known in the art.

Tubing 12 is connected beneath the lowermost side pocket mandrel 16 and extends below a production packer 18 which seals the annulus 20 created between side pocket mandrels 16 and casing 14. Production packers are known in the art. Tubing 12 and side pocket mandrels 16 can be connected by any means known in the art. The lowest side pocket mandrel 16 and its associated gas lift valve 22 represent the lowermost injection point of gas lift system 10. As such, the lowermost injection point is located above packer 18. A perforations interval 24 is located below production packer 18 for retrieving production fluids.

The operation of prior art gas lift system 10 will now be described. Once gas lift system 10 is completed downhole, gas is injected from the surface down through annulus 20. Packer 18 traps the gas within annulus 20, thereby creating a supercharged annulus 20 having pressurized gas within. As the pressure increases, the pressure within annulus 20 becomes sufficiently greater than the pressure inside side pocket mandrels 16 and/or tubing 12, thereby forcing gas lift valves 22 to open and the pressurized gas to flow into side pocket mandrels 16 where it assists in lifting the production fluids. The pressure threshold of valves 22 can be varied as desired.

Figure 2:
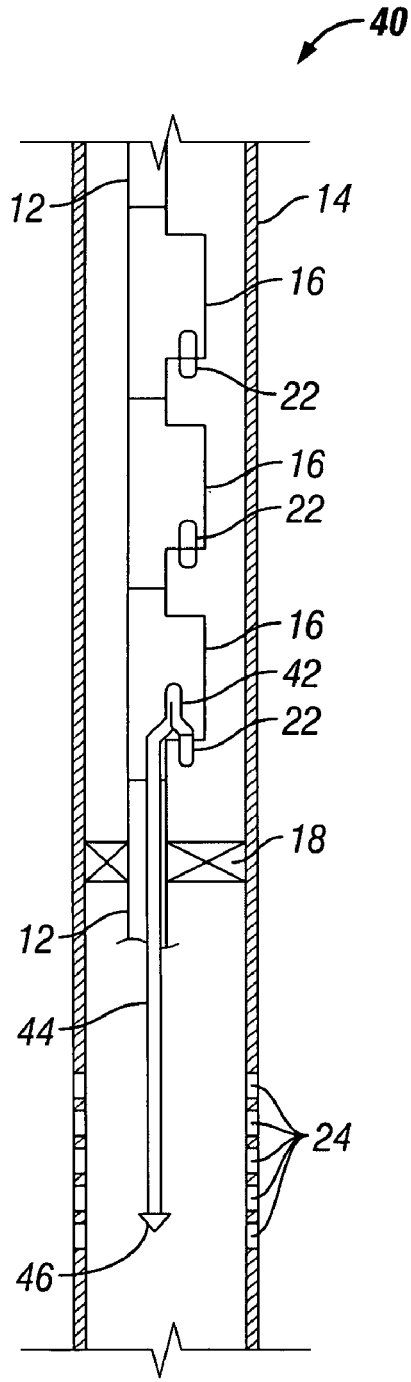
FIG. 2 illustrates a gas lift system according to an exemplary embodiment of the present disclosure.

FIG. 2 illustrates a gas lift system 40 according to an exemplary embodiment of the present disclosure. Here, tubing 12 again extends down inside casing 14 where a series of side pocket mandrels 16, attached one above the other, are connected beneath the tubing 12. Gas lift system 40 is illustrated as having three side pocket mandrels 16, however, those skilled in the art having the benefit of this disclosure realize any number of side pocket mandrels 16 may be utilized as desired. A packer 18 is landed beneath the lowermost side pocket mandrel 16 in order to seal the annulus 20 as previously discussed.

Figure 3:
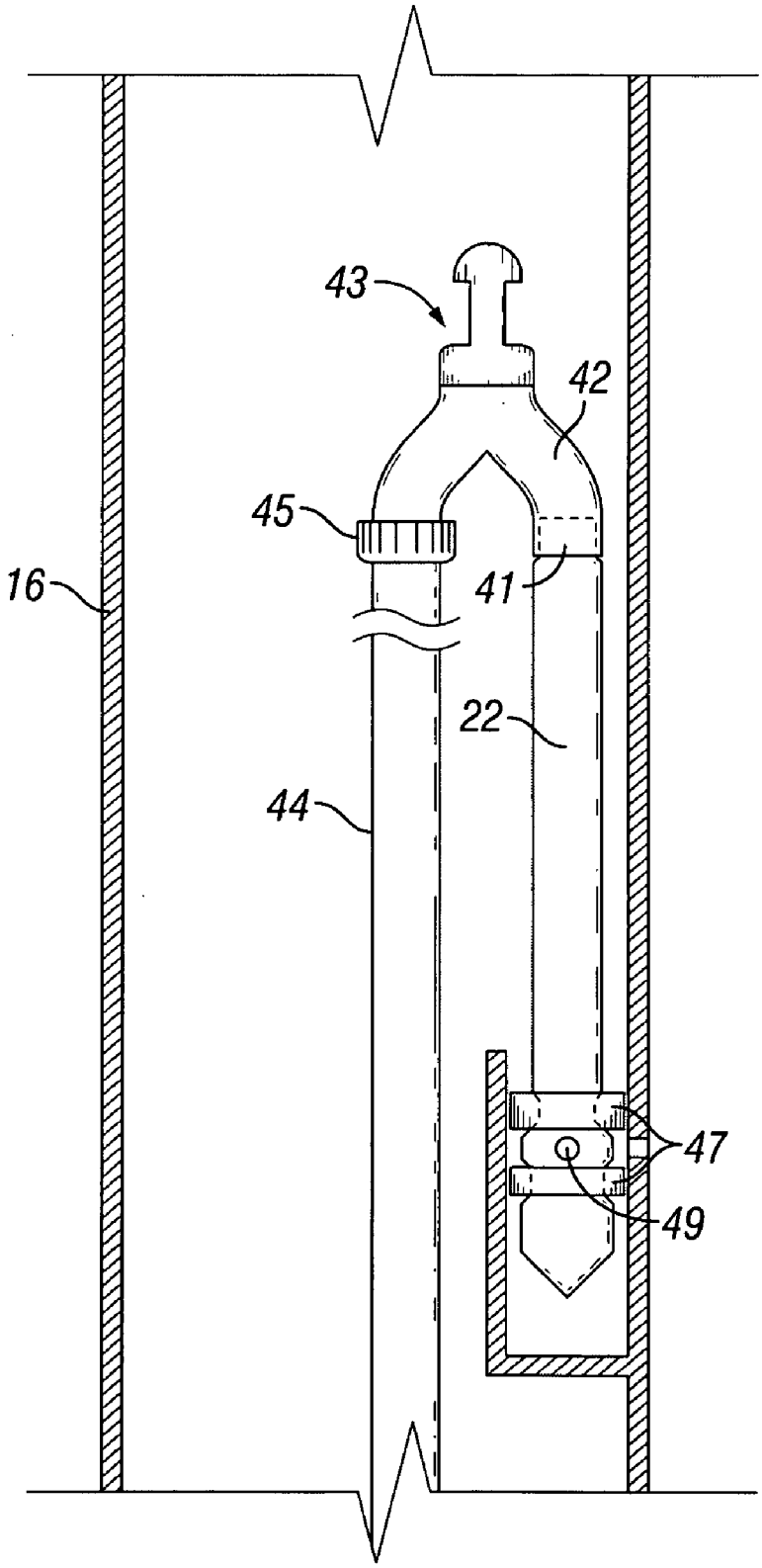
FIG. 3 illustrates a turn-over suspension mandrel according to an exemplary embodiment of the present disclosure.

Referring to the exemplary embodiments of FIGS. 2 and 3, a turn-over suspension mandrel 42 is connected to the gas lift valve 22 of the lowermost side pocket mandrel 16 via a compression fitting, roll-on connector or other suitable connector 41. However, please note that those skilled in the art having the benefit of this disclosure realized turn-over suspension mandrel 42 may be connected to other side pocket mandrels 16 instead of the lowermost side pocket mandrel 16. Gas lift valve 22 has packing devices 47 and port 49 which operate to regulate the entrance of the pressurized gas from annulus 20 as known in the art. Gas lift valves are known in the art and those skilled in the art having the benefit of this disclosure realize a variety of gas lift valves can be utilized with the present disclosure.

Further referring to the exemplary embodiment of FIG. 3, turn-over suspension mandrel 42 is constructed such that it turns over 180 degrees to connect to coil 44 via a compression fitting, roll-on connector or other suitable connector 45. Coil 44 can be, for example, a ¾ or 1 inch diameter coil, however, those skilled in the art having the benefit of this disclosure realize a variety of coil diameters may be utilized. A fishing neck 43 is located atop turn-over suspension mandrel 42 to provide a means by which turn-over suspension mandrel 42 may be landed and retrieved if desired.

Further referring to the exemplary embodiment of FIG. 2, the coil 44 extends from the turn-over suspension mandrel 42 down through the tubing 12 and into the perforated interval 24 below the packer 18. A plug 46 is connected to the bottom of coil 44 in order to seal coil during installation of the turn-over suspension mandrel 42 and prevent pressurized fluid from traveling back uphole via the coil 44. Once the turn-over suspension mandrel 42 has been landed inside the lowermost side pocket mandrel 16, the coil 44 may be pressurized in order to remove plug 46, thereby enabling the pressurized gas to be communicated downhole. In the most preferred embodiment, plug 46 may be, for example, an aluminum pump-out plug. Other types of plugs may be used such as, for example, frangible disks.

The operation of the before-mentioned exemplary embodiment of the present disclosure will now be described in relation to FIGS. 2 and 3. After gas lift system 40 has been connected downhole, fluid production may begin. Although side pocket mandrels 16 have been connected, each currently has a "dummy valve" as known in the art. "Dummy valves," which act as plugs, may be utilized in place of gas lift valves 22 until gas lift valves 22 are needed. Also, in the most preferred embodiment, when fluid production first begins, turn-over suspension mandrel 42 has not been landed inside lowermost side pocket mandrel 16 because the pressure created by the wellbore itself is generally sufficient to produce the fluids uphole.

Once the well begins to deplete and/or gas lift is otherwise necessary or desired, gas lift valves 22 may be landed inside side pocket mandrels 16. A wireline tool, such as for example, a kickover tool as understood in the art, is run down inside tubing 12 to side pocket mandrels 16 in order to jerk out the dummy valves and stab in gas lift valves 22 via a fishing neck on gas lift valves 22. Once the kickover tool is run down inside side pocket mandrels 16, it is actuated such that its profile changes to allow it to reach over in to the side pocket of side pocket mandrel 16, the operation of which is known in the art. Those skilled in the art having the benefit of this disclosure realize there are a number of methods by which gas lift valves 22 may be landed inside side pocket mandrels 16.

Once gas lift valve 22 is landed inside the lowermost side pocket mandrel 16, turn-over suspension mandrel 42 is also run downhole using the wireline tool and connected to gas lift valve 22. Also, before turn-over suspension mandrel 42 is run downhole, coil 44 has already been connected thereto. Once turn-over suspension mandrel 42 is landed, coil 44 will become pressurized from the annulus, thus forcing plug 46 off the end of coil 44, thereby enabling subsequent communication. In an embodiment, plug 46 can be an aluminum pump-out plug which will dissolve within the downhole environment. After turnover suspension mandrel 42 and coil 44 are installed, the wireline tool is retrieved and gas lift system 40 is ready to begin operating.

Once the wireline tool is retrieved, gas is injected down through annulus 20 where packer 18 creates a supercharged annulus 20 having the pressurized gas therein. As discussed previously, gas lift valves 22 seek to equalize the pressure between tubing 12 and annulus 20. However, unlike the other upper gas lift valves 22 that do not have turn-over suspension mandrel 42 connected thereto, the lowermost gas lift valve 22 senses the tubing pressure via coil 44, which extends down into the wellbore beneath packer 18. Once the pressure in annulus 20 becomes sufficiently greater than the pressure inside coil 44, gas lift valve 22 of the lowermost side pocket mandrel 16 opens, allowing the pressurized gas to travel into lowermost side pocket mandrel 16 via port 49. Because the lowermost side pocket mandrel 16 has turn-over suspension mandrel 42 connected thereto, the pressurized gas entering the lowermost side pocket mandrel 16 is turned over 180 degrees and communicated down through coil 44. As such, gas lift system 40 provides a gas injection point below production packer 18.

Figure 4:
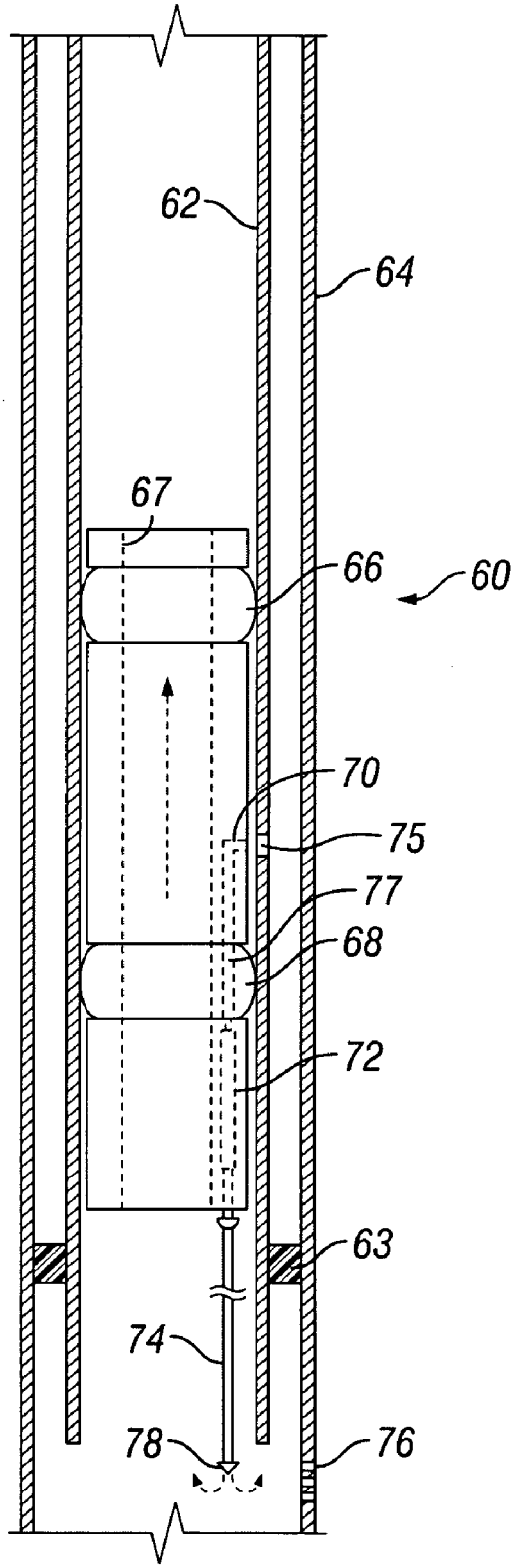
FIG. 4 illustrates a gas lift system according to an alternative exemplary embodiment of the present disclosure.

FIG. 4 illustrates an alternative exemplary embodiment of the present disclosure used in conjunction with a pack off assembly 60. As shown, a production tubing 62 is located inside casing 64. Pack off assembly 60 is landed inside production tubing 62, as known in the art, and includes a longitudinal bore 67 there-through for production flow. A production packer 63 is located below pack-off assembly 60 to seal the annulus between tubing 62 and casing 64.

Pack-off assembly 60 includes an upper packer element 66 and a lower packer element 68. A perforation 75 is positioned in production tubing 62 along the tubing interval between upper packer 66 and lower packer 68. Pack-off assembly 60 includes a gas inlet port 70 located adjacent the perforation 75 in tubing 62. Gas inlet port 70 provides fluid communication from perforation 75 down through the body of pack-off assembly 60 via a gun drill 77 and to a gas lift valve 72, also located along the body of pack-off assembly 60. The construction and operation of pack-off assemblies are known in the art.

According to an alternative embodiment of the present disclosure, a coil 74 may be connected to gas lift valve 72 via a suitable connector, such as a compression fitting (not shown). In the most preferred embodiment, coil 74 is connected to the distal end of gas lift valve 72. However, those skilled in the art having the benefit of this disclosure realize there are a number of ways to connect coil 74. Coil 74 extends down from gas lift valve 72 past production packer 63 and down into perforations 76, as illustrated in FIG. 4. A plug 78 is attached to the end of coil 74, as discussed previously. Accordingly, the compressed gas flowing into the perforated tubing 62 and gas inlet port 70 of pack-off assembly 60, can be introduced below production packer 63 in order to provide a deepened location for gas lift.

Although various embodiments have been shown and described, the disclosure is not so limited and will be understood to include all such modifications and variations as would be apparent to one skilled in the art.

What is claimed is:

1. A gas lift system, comprising:

a well casing;

a production tubing extending into the well casing so as to form an annulus between the well casing and the production tubing;

a production packer positioned in the annulus;

a gas lift valve positioned in the production tubing above the production packer, the gas lift valve providing fluid communication between the annulus and the production tubing; and a coil in fluid communication with the gas lift valve, the coil extending down into the production tubing below the production packer; and a turn-over suspension mandrel that provides fluid communication between the gas lift valve and the coil.

2. The gas lift system of claim 1, further comprising a fishing neck attached to the turn-over suspension mandrel.

3. The gas lift system of claim 1, wherein the well casing comprises perforations positioned below the production packer, the coil extending down proximate to the perforations.

4. The gas lift system of claim 1, further comprising a side pocket mandrel, the gas lift valve being positioned in the side pocket mandrel.

5. The gas lift system of claim 4, wherein the gas lift system comprises a plurality of side pocket mandrels, the gas lift valve being positioned in the lowermost side pocket mandrel.

6. The gas lift system of claim 1, further comprising a plug attached to the end of the coil.

7. The gas lift system of claim 1, wherein the turn-over suspension mandrel is configured such that it turns over 180 degrees between the gas lift valve and the coil.

8. A method for providing gas lift to a well production fluid being produced by a well, the well including a well casing, a production tubing extending into the well casing so as to form an annulus between the well casing and the production tubing and a production packer positioned in the annulus, the method comprising:

positioning a gas lift valve in the production tubing above the production packer;

running a coil into the production tubing so as to be in fluid communication with the gas lift valve, the coil extending down into the production tubing below the production packer;

injecting gas into the annulus, the gas flowing from the annulus through the coil and into the production fluid at an injection point below the production packer; and running a turn-over suspension mandrel into the production tubing and attaching it to the gas lift valve so that it is capable of providing fluid communication between the gas lift valve and the coil, the mandrel being configured so that gas flowing up through the gas lift valve is then diverted downward by the turn-over suspension mandrel into the coil.

9. The method of claim 8, wherein the coil is attached to the turn-over suspension mandrel prior to running the turn-over suspension mandrel into the production tubing.

10. The method of claim 8, wherein the well casing comprises perforations positioned below the production packer, the gas being injected proximate to the perforations.

11. The method of claim 8, wherein the gas is introduced into the production tubing via a gas inlet port positioned proximate a packoff assembly.

12. The method of claim 8, wherein a plug is attached to the end of the coil during the running of the coil into the production tubing.

13. The method of claim 12, wherein during the injecting, the gas flowing from the annulus causes the plug to be forced off the end of the coil.

14. The method of claim 8, wherein the turn-over suspension mandrel is configured such that it turns over 180 degrees between the gas lift valve and the coil.

15. A gas lift system, comprising:

a well casing;

a production tubing extending into the well casing so as to form an annulus between the well casing and the production tubing;

a production packer positioned in the annulus;

a gas lift valve positioned in the production tubing above the production packer, the gas lift valve providing fluid communication between the annulus and the production tubing;

a coil in fluid communication with the gas lift valve, the coil extending down into the production tubing below the production packer;

a pack off assembly in the production tubing, the pack off assembly comprising:

a longitudinal bore for production flow, a second annulus being formed between the longitudinal bore and the production tubing;

an upper packer element positioned in the second annulus;

a lower packer element positioned in the second annulus below the upper packer element;

wherein a production tubing perforation is positioned between the upper packer element and the lower packer element;

wherein a gas inlet port is positioned to be in fluid communication with the perforation; and a gun drill that provides fluid communication between the perforation and the gas lift valve, the gun drill extending through the lower packer element.

* * * * *